United States Patent [19]

Braun et al.

[11] Patent Number: 4,477,119

[45] Date of Patent: Oct. 16, 1984

[54] PLANING MACHINE FOR UNDERGROUND MINING WITH A CUTTER IN THE TRANSITION RANGE FROM LONGWALL TO DRIFT, PARTICULARLY FOR A SIMULTANEOUSLY MINED DRIFT

[75] Inventors: Gert Braun; Ernst Braun, both of Essen-Heisingen; Walthorst Herwig, Erkelenz/Hetzerath, all of Fed. Rep. of Germany

[73] Assignee: Halbach & Braun Maschinenfabrik GmbH & Co., Fed. Rep. of Germany

[21] Appl. No.: 362,381

[22] Filed: Mar. 26, 1982

[30] Foreign Application Priority Data

Apr. 4, 1981 [DE] Fed. Rep. of Germany ..... 3113720

[51] Int. Cl.[3] ..... E21C 27/34

[52] U.S. Cl. ..... 299/34; 299/43; 198/601

[58] Field of Search ..... 299/34, 43, 32, 89, 299/53; 198/606, 607, 601, 580, 735

[56] References Cited

U.S. PATENT DOCUMENTS

| | | | |
|---|---|---|---|
| 2,864,489 | 12/1958 | Walker | 198/607 |
| 3,014,707 | 12/1961 | Davies | 299/43 |
| 3,409,329 | 11/1968 | Dommann et al. | 299/43 X |
| 3,711,160 | 1/1973 | Mennekes et al. | 299/43 |
| 4,068,688 | 1/1978 | Benson | 299/89 X |
| 4,094,400 | 6/1978 | Braun et al. | 198/580 X |
| 4,180,291 | 12/1979 | Löbbe et al. | 299/43 X |
| 4,248,482 | 2/1981 | Truszcinski | 299/43 X |
| 4,279,445 | 7/1981 | Hauschopp | 299/34 |
| 4,349,229 | 9/1982 | Becker et al. | 299/43 X |

FOREIGN PATENT DOCUMENTS

| | | | |
|---|---|---|---|
| 2803519 | 8/1979 | Fed. Rep. of Germany | 299/43 |
| 2035247 | 6/1980 | United Kingdom | 198/606 |
| 0757709 | 8/1980 | U.S.S.R. | 299/43 |

*Primary Examiner*—James A. Leppink
*Assistant Examiner*—Beverly E. Hjorth
*Attorney, Agent, or Firm*—McGlew & Tuttle

[57] ABSTRACT

A mining apparatus comprises a planing device which is movable along a longwall to the drift and has a longwall conveyor which extends alongside it and is deflected into the drift for the removal of the cutaway material. A cutter is operable in the transition between the longwall and the drift and includes a rotatable shaft which is rotatable on a conveyor in the transition between the longwall and the drift and includes an outer arm which carries a rotatable cutting wheel which is moved by the swivel arm through the cutting zone at the transition between the longwall and the drift. The swivel arm is pivotable on a bearing shaft which carries a chain wheel which is driven from a chain drive which operates a plane cutter which is movable along the longwall. The chain drive includes a chain wheel which is rotatable with the bearing shaft and is connected by a separate cutter chain drive which extends through the swivel arm to a chain wheel affixed to the shaft of the cutter wheel.

13 Claims, 3 Drawing Figures

PLANING MACHINE FOR UNDERGROUND MINING WITH A CUTTER IN THE TRANSITION RANGE FROM LONGWALL TO DRIFT, PARTICULARLY FOR A SIMULTANEOUSLY MINED DRIFT

FIELD AND BACKGROUND OF THE INVENTION

The invention relates in general to mining and in particular to a new and useful planing machine for underground mining with a cutter in the transition range from the longwall to the drift, particularly for a simultaneously mined seam drift, where the planing and cutting range overlap and the cutter is driven over a bearing shaft with guide rollers for the plane chain.

A planing machine is already known where the plane guide has an extension projecting into the drift range. This extension is designed for guiding a cutting disk with a disk guide in such a way that the cutting range leading into the drift overlaps the planing range. This permits mechanical clearing even of the dead space not covered by the plane, because in the longwall drift transition range, the reciprocating cutting disc now clears out the planing dead space, which otherwise has to be cleared manually. This planing machine has asserted itself in practice but it requires more space for the temporary storage of the coal mined in the end position of the plane and which is to be evacuated.

SUMMARY OF THE INVENTION

The invention provides a planing machine for underground mining where the cutter is so designed that a wide rough cut is achieved in the longwall drift transition range to permit the temporary storage of the mined coal until it is evacuated, and to effect coverage of the mining front by the plane and consequently a straight cut is ensured.

This problem is solved by the invention in a planing machine of the above-described type in this way that the cutter has a swivel arm with cutting rolls covering the longwall drift transition range, where the cutting roll is rotatably mounted on one end of the swivel arm with a vertical bearing shaft, and the swivel arm is swingably mounted with its other end on the bearing shaft for the guide rollers. In addition, the chain wheels for a revolving driving chain are arranged on both bearing shafts for the swivel arm and for the cutting roll, the driving chain being driven by the plane chain over its guide rollers, bearing shaft, and the chain wheel secured thereon. These measures of the invention have the result that the cutting roll is swung back and forth by means of the swivel arm in the longwall drift transition range in dependence on the direction of motion of the plane and the plane chain which respectively describe a circular arc with a given arc length. In this way a circular segment-type rough cut is obtained for the temporary storage of the coal brought in by the plane in an end position, which is not yet transferred to the longwall conveyor. Beyond that, the rough cut also holds the coal mined by the cutting roll until it is evacuated. Since the circular arc-type rough cut and the mining front overlap, the coal plane can now cover the mining front into the rough cut range to obtain a straight cut. As a result, a head roughing cutter is actually realized according to the teaching of the invention.

The drive of the cutting roll by the plane chain and driving chain is so designed in dependence on the direction of motion if the plane chain that the cutting roll is in its end position in the drift range when the plane has reached its end position associated with this drift, normally called a band drift, and the cutting roll is in its end position in the longwall range when the plane has reached its other end position, normally called a head drift. This way a collision of cutting roll and plane is impossible. The drive of the swivel arm with the cutting roll to perform the swivel movement in the direction of motion of the plane chain is effected solely over the plain chain or the bearing shaft for its guide rollers, because the torque required for the swivel movement is composed of the frictional resistances between the plane chain and the bearing for the swivel arm. The swivel arm thus follows in the direction of motion of the plain chain. At the same time, the cutting roll engaging the mining front rotates about its center in the swivel arm and works because it is likewise driven over the chain wheels and the driving chain by the bearing shaft with the guide rollers for the plane chain and consequently by the plane chain. As soon as the cutting roll is in engagement, the torque for the swivel movement of the swivel arm increases, so that an adequate torque is available for the swivel movement and for the drive of the cutting roll. The cutting roll advances in the course of the advancement of the entire planing machine.

According to a preferred embodiment of the invention, a cam conveyor, e.g. a chain conveyor with a separate drive is associated with the longwall conveyor in the longwall drift transition range. The chain conveyor is arranged between the cutting roll and the guide rollers for the plane chain. It has a charging end facing the longwall and is aligned with the planing range or the plane, and, in the drift, a transfer end is fed to the longwall conveyor. This transfer end can be designed for head or lateral discharge and can project over the longwall conveyor. At any rate the cam conveyor serves to receive with its charging end a considerable portion of the coal mined by the plane and to be evacuated. Actually the plane pushes this coal over the charging end until it has reached its end position. Besides, the cam conveyor is charged by the cutting roll with mined coal, regardless of whether it has been obtained by planing or cutting. This way the coal stored temporarily by the rough cut is immediately evacuated by the cam conveyor.

A swivel arm portion of the conveyor is preferably designed as a box-shaped hollow section, and the chain wheels and the drive chain are arranged so that they are protected in the hollow section. Principally it is possible that a separate drive, e.g, a hinged pneumatically or hydraulically operated double-action cylinder-piston arrangement or with a rack and pinion drives the swivel arm. A separate drive may be advisable under particularly difficult mining conditions. Another possibility of increasing the torque for the swivel movement of the swivel arm and thus of the cutting roll consists in assigning to the advancing and returning chain strand of the drive chain a braking device, e.g. brake shoes or a sluggish-flow tube, so that the frictional resistance required for the formation of the torque can be considerably increased.

The cutting roll is advantageously divided into several cutting disks arranged above and below the swivel arm in order to achieve the desired adaptation to the thickness of the seam, particularly when the seam drift is mined at the same time. Principally it is possible to assign to the cutting roll a separate drive too. Preferably the cam conveyor has a loading ramp in the cutting range on the side facing the cutting roll, so that the transfer of the coal mined by the coal plane, and particularly by the cutting roll, to the cam conveyor is facilitated. To this end the cam conveyor has a swing bar adjoining the leading ramp, preferably in the range of the drift, and both form in the transition range of leading ramp and swing bar a safety arm branching off from the longwall conveyor and defining the cutting range. In the range of the safety arm can be provided a stop for the swivel arm, so that the cutting roll necessarily pushes the mined coal in its end position in the drift range on the safety arm and thus on the loading ramp. Because even in the end position, the cutting roll continues to run, only the swivel movement is stopped until the plane and consequently the plane chain return to swing the swivel arm with the cutting roll in the same direction toward the longwall.

The advantages achieved by the invention are seem substantially in that it provides a planing machine for underground mining with a cutter in the transition range of the longwall and the drift, particularly for a simultaneously mined seam drift, where the cutter works as a head roughing cutter and ensures a wide rough cut in the longwall drift transition range for the temporary storage of the coal mined in this range until it is evacuated. Besides, it permits coverage of the mining front by the coal plane, and ensures thus a straight cut. In addition, the planing machine according to the invention can be equipped with a rolling cam for the longwall conveyor. Beyond that the use of a striker head machine is possible. If the seam drift is mined at the same time. The material loosened by the striker head machine in the drift range on the face wall drops either directly into the cam conveyor, or it is transferred by means of the travelling cutting roll to the cam conveyor and is likewise evacuated. Of particular, importance within the framework of the invention is the drive for the cutting roll and its swivel arm, which can be effected exclusively over the revolving plane chain. This way a particularly simple and efficient head roughing cutter is realized.

Accordingly it is an object of the invention to provide in a mining apparatus which comprises a planing device movable along a longwall to the drift and having a longwall conveyor extending alongside the longwall and deflected into the drift for the removal of cutaway material, the improvement comprising a cutter which is operable in a transition between the longwall and the drift and includes a rotatable bearing shaft rotatably mounted adjacent the longwall conveyor in the transition zone between the longwall and the drift and the swivel arm which has an inner end connected to the bearing shaft and rotatable therewith and has an outer end which is swingable in a cutting zone between the drift and the longwall and has at least one rotatable cutting wheel thereon for cutting away material in the cutting zone and which is driven by a chain drive connected to the bearing shaft and extending through the swivel arm to the cutting wheel.

A further object of the invention is to provide a mining apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
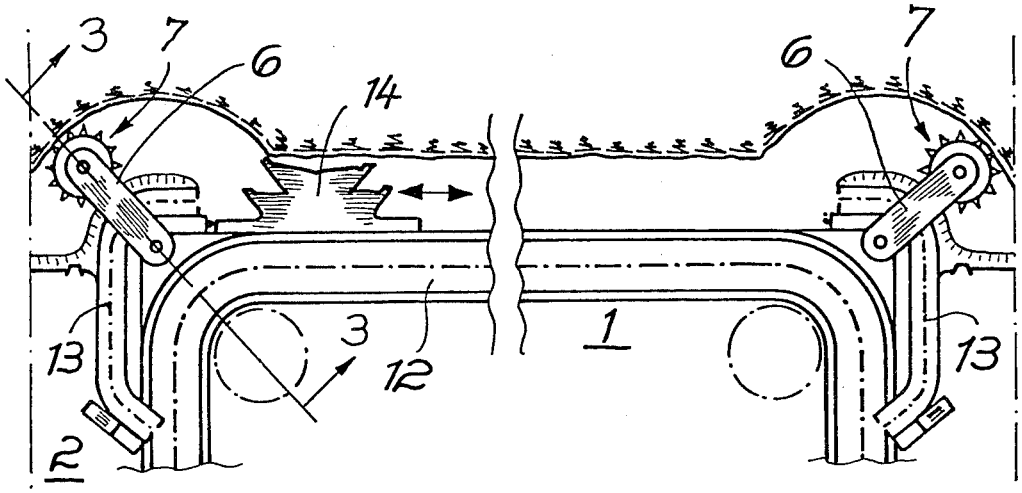
FIG. 1 is a schematic top plan view of a mining apparatus constructed in accordance with the invention.
Figure 3:
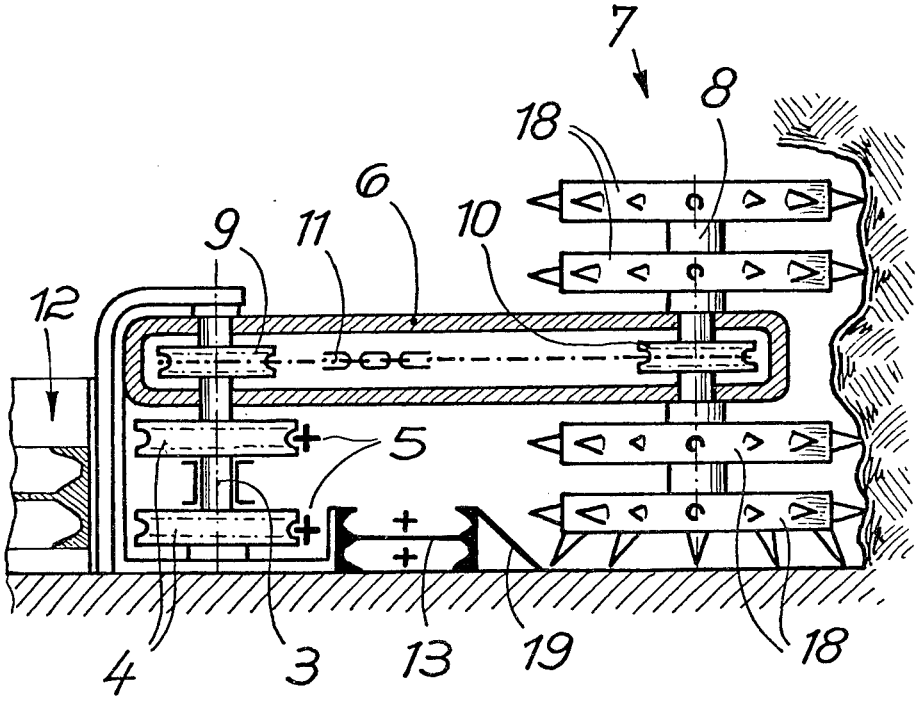
FIG. 3 is a partial vertical section taken along the lines 3—3 of FIG. 1.

Referring to the drawings in particular the invention embodied therein comprises a mining apparatus which includes a planing device 14 which is movable along a longwall 1 through the drift designated 2 and has a longwall conveyor 12 associated therewith which extends alongside it and is deflected into the drift. In accordance with the invention cutter 7 is operable in a transition zone between the longwall and the drift 2 on either end as shown in FIG. 1 for example The figures show a planing machine for underground mining with a cutter in the transition range from longwall 1 to drift 2, particularly for a simultaneously mined seam drift. The planing and the cutting range overlap.

The cutter is driven from a drive connected to a first bearing shaft 3 with guide rollers 4 for a plain chain 5. The cutter has a swivel arm 6 with a cutting roll 7 covering the longwall drift transition range. Cutting roll 7 is rotatably mounted at one end of the swivel arm 6 on a second vertical bearing shaft 8 and swivel arm 6 is swingingly mounted with its other end on the bearing shaft 3 for the guide rollers 4 of the plane chain 5. On both bearing shafts 3 and 8 are arranged chain wheels 9, 10 for a revolving driving chain 11 for both the swivel arm 6 and for the cutting roller 7, on the other hand. The driving chain 11 is driven by the plane chain 5 which is directed over its guide rollers 4 on the bearing shaft 3, and also over the chain wheel 9 secured thereon. One roller 4 is fixed to shaft 3 and produces a torque for the drive of swivel arm 6, taking into account the frictional resistances appearing in this range. The other roller 4 is freely rotatable on shaft 3.

A longwall conveyor 12 is deflected into drift 2 and is associated, in the longwall drift transition range, with a cam conveyor 13, which comprises, e.g. a chain conveyor with a separate drive. Cam conveyor 13 is arranged between cutting roll 7 and guide rollers 4 for plane chain 5. At its end facing the longwall 1, cam conveyor 13 has a charging end 15 aligned with the planing range or plane 14. In the drift 2, however, it has a transfer end 16 fed to longwall conveyor 12, which can project over longwall conveyor 12. The swivel arm 6 comprises a box-shaped hollow section. In swivel arm 6 are arranged chain wheels 9, 10 and driving chain 11.

Figure 2:
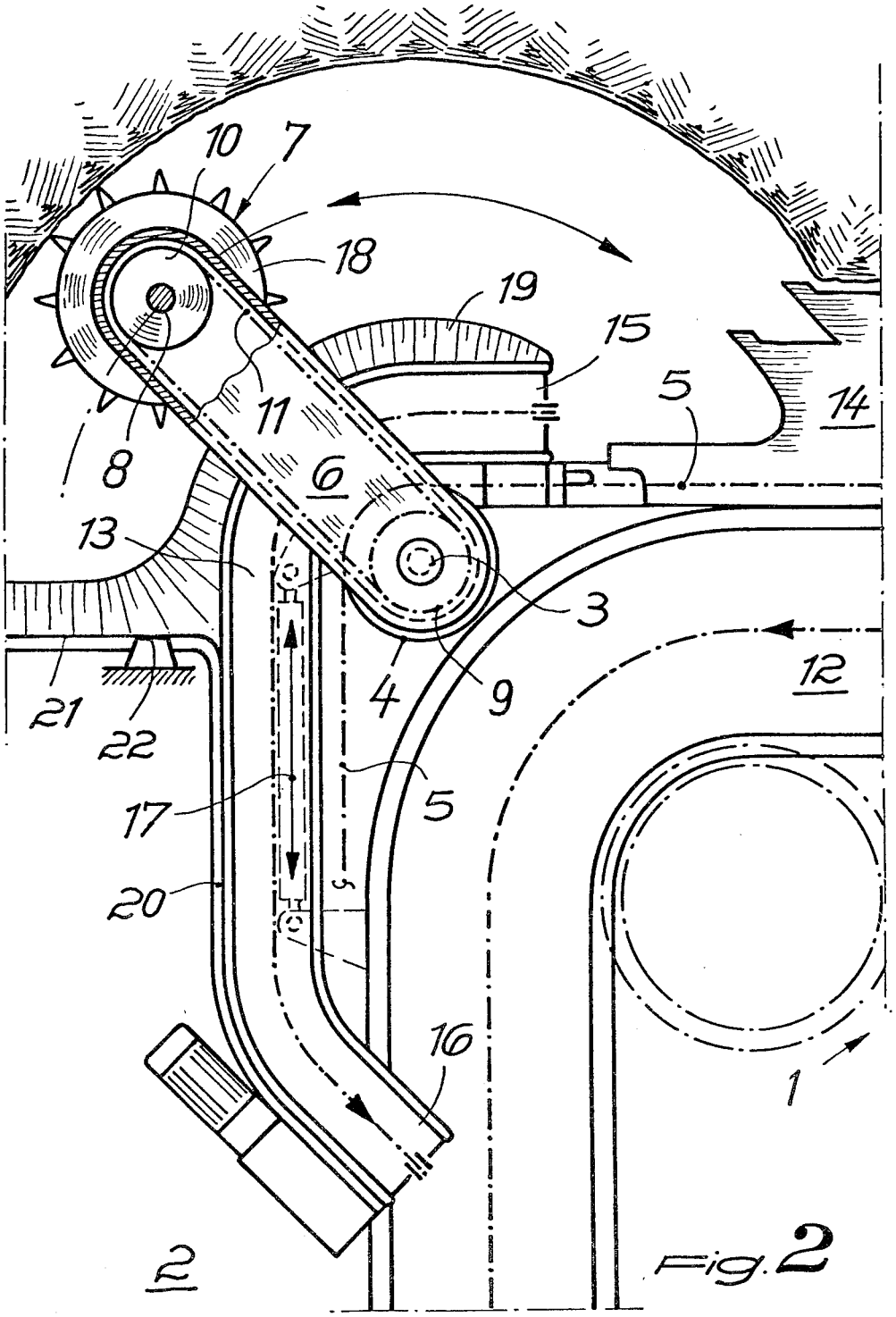
FIG. 2 is an enlarged view of the portion of the apparatus shown in FIG. 1.

The swivel arm 6 can advantageously be moved by a separate drive, e.g. a hinged pneumatically or hydraulically operated double-action cylinder piston arrangement 17 shown in FIG. 2 in dotted lines. In addition, a braking device, e.g. brake shoes or a sluggish-flow tube (not shown) is advantageously assigned to the advancing or returning chain strand of drive chain 11 in order to increase the frictional resistance and thus the torque.

The cutting roll 7 advantageously comprises several cutting disks 18 arranged both above and below the swivel arm 6. A separate drive (not shown) is advantageously also connected to the cutting roll 7 when it is deemed expedient.

The cam conveyor 13 has on its side facing cutting roll 7 a loading ramp 19 in the cutting range. In the range of drift 2 it has a swing bar 20 adjoining the loading ramp to increase its filling cross section. In the transition range from loading ramp 19 to swing bar 20, both form a safety arm 21 for the mined coal, which branches off from longwall conveyor 12 and defines the cutting range. In the range of safety arm 21 can be provided a stop 22 for swivel arm 6.

While a specific embodiment of the invention has been shown and described in detail to illustrate the application of the principles of the invention, it will be understood that the invention may be embodied otherwise without departing from such principles.

What is claimed is:

1. In a mining apparatus comprising a planing device which is movable along a longwall to a drift and has a longwall conveyor extending alongside the longwall deflected into the drift for the removal of cut away material, the improvement comprising a cutter operable in a transition area between the longwall and drift including a first bearing shaft rotatably mounted to the longwall conveyor in the transition area, a swivel arm having an inner end pivotal to said first bearing shaft and swingable in a cutting zone between the drift and the longwall, a second bearing shaft rotatably mounted to said swivel arm and at an outer end thereof, at least one rotatable cutting roll connected to said second bearing shaft and rotatable therewith at said swivel arm outer end for cutting away material in the cutting zone, a cutting roll chain engaged between said first bearing shaft and second bearing shaft to rotate said cutting roll to cut away material in the cutting zone, a plane chain movably mounted with respect to the longwall conveyor and connected to the planing device for moving the planing device along longwall, and a guide roller connected to said first bearing shaft for rotation therewith, said plane chain engaged on said guide roller for rotating said guide roller to rotate said first bearing shaft.

2. In a mining apparatus according to claim 1, including a cam conveyor alongside the longwall conveyor having a material charging end adjacent an intersection of said cutting zone with a planing area along the longwall conveyor acting to deflect material from the cutting zone onto said longwall conveyor.

3. A planing machine according to claim 2, wherein said cam conveyor includes an entrance in the cutting zone and a discharge overlying said longwall conveyor.

4. In a mining apparatus according to claim 1, including a longwall conveyor having a longwall portion and a deflected portion extending into the drift with a corner between said portions and a cam conveyor located in said corner including a charging end disposed in said cutting zone and a discharge end extending to said longwall conveyor and means connected to said longwall conveyor for shifting said swivel arm relative to said longwall conveyor.

5. In a mining apparatus according to claim 4, wherein said means for shifting comprises a double action fluid pressure operated piston and cylinder combination.

6. In a mining apparatus according to claim 1, including a cam conveyor adjacent said swivel arm having a charging end exposed in the cutting range and a discharge end adapted to discharge into the longwall conveyor.

7. In a mining machine according to claim 1, wherein said cam conveyor includes an inclined loading ramp portion at said charging end and a swing bar bracket extending around said cam conveyor from said cutting zone to the transfer end of said cam conveyor, said swing bar bracket being located at the beginning of the cutting range and defining the extent of said cutting range.

8. In a mining apparatus according to claim 1, including a stop disposed adjacent the cutting range in a position to intercept the path of travel of said swivel arm and limit the range of movement thereof.

9. In a mining apparatus according to claim 1, including a first drive chain wheel connected for rotation to said first bearing shaft and a second drive chain wheel connected for rotation to said second bearing shaft, said cutting roll chain engaged over said first and second drive chain wheel.

10. In a mining apparatus according to claim 1, wherein said swivel arm is a hollow tubular member, said cutting roll including said second bearing shaft extending through said hollow tubular member and having a cutter drive wheel thereon afixed thereto for rotation therewith, said first bearing shaft having a portion extending through said swivel member and having a driving chain wheel thereon located within said swivel arm hollow portion, and said cutting roll chain extending between said chain wheel and said cutter drive wheel.

11. In a mining apparatus according to claim 1, including separate drive means connected between the longwall conveyor and said swivel arm for swiveling said swivel arm on said first bearing shaft.

12. In a mining apparatus according to claim 11 wherein said separate drive means comprises a double-action piston/cylinder combination connected between said swivel arm and the longwall conveyor.

13. In a mining apparatus according to claim 1, wherein said cutting roll comprises a plurality of cutter disks and said second bearing shaft carrying all of said cutter disks rotatably mounted on said swivel arm.

* * * * *